US005814404A

United States Patent [19]

Rutherford et al.

[11] Patent Number: 5,814,404

[45] Date of Patent: Sep. 29, 1998

[54] DEGRADABLE MULTILAYER MELT BLOWN MICROFIBERS

[75] Inventors: Denise R. Rutherford, Oakdale; Eugene G. Joseph, Vadnais Heights, both of Minn.

[73] Assignee: Minnesota Mining and Manufacturing Company, St. Paul, Minn.

[21] Appl. No.: 253,690

[22] Filed: Jun. 3, 1994

[51] Int. Cl.[6] ..... D07G 3/00

[52] U.S. Cl. ..... 428/364; 428/373; 428/397; 442/345; 442/361; 442/335; 442/347

[58] Field of Search ..... 428/364, 370, 428/373, 397; 442/361, 335, 347, 345

[56] References Cited

U.S. PATENT DOCUMENTS

| | | | |
|---|---|---|---|
| 3,840,512 | 10/1974 | Brackman | 260/94.9 |
| 3,864,293 | 2/1975 | Miyoshi et al. | 260/23.7 |
| 3,921,333 | 11/1975 | Clendinning et al. | 47/37 |
| 4,016,117 | 4/1977 | Griffin | 260/17.4 |
| 4,038,228 | 7/1977 | Taylor | 260/23 |
| 4,067,836 | 1/1978 | Potts et al. | 260/23 |
| 4,101,720 | 7/1978 | Taylor et al. | 526/3 |
| 4,324,709 | 4/1982 | Griffin | 523/210 |
| 4,420,576 | 12/1983 | Griffin | 524/47 |
| 4,931,488 | 6/1990 | Chiquet | 523/126 |
| 4,948,820 | 8/1990 | Addeo et al. | 523/124 |
| 5,053,482 | 10/1991 | Tietz | 528/272 |
| 5,059,642 | 10/1991 | Jane et al. | 524/52 |
| 5,108,807 | 4/1992 | Tucker | 428/35.2 |
| 5,135,966 | 8/1992 | Chatterjee et al. | 523/126 |
| 5,147,712 | 9/1992 | Miyahara et al. | 428/224 |
| 5,176,952 | 1/1993 | Joseph | 442/345 |
| 5,196,247 | 3/1993 | Wu et al. | 428/43 |
| 5,207,970 | 5/1993 | Joseph et al. | 264/518 |
| 5,216,043 | 6/1993 | Sipinen et al. | 523/126 |
| 5,232,770 | 8/1993 | Joseph | 442/345 |
| 5,238,733 | 8/1993 | Joseph | 442/345 |
| 5,248,326 | 9/1993 | Burton | 71/8 |
| 5,258,220 | 11/1993 | Joseph | 428/373 |
| 5,258,422 | 11/1993 | Chang et al. | 523/124 |

FOREIGN PATENT DOCUMENTS

| | | |
|---|---|---|
| 2071133 | 12/1992 | Canada . |
| 0 394 803 A1 | 10/1990 | European Pat. Off. . |
| 0 418 196 A1 | 3/1991 | European Pat. Off. . |
| 0 546 530 A2 | 6/1993 | European Pat. Off. . |
| 0 649 594 | 4/1995 | European Pat. Off. . |
| 06248551 | 10/1990 | Japan . |
| 2 100 268 | 12/1982 | United Kingdom . |
| WO 92/11298 | 7/1992 | WIPO . |
| WO 94/00163 | 1/1994 | WIPO . |
| WO 94/00293 | 1/1994 | WIPO . |

OTHER PUBLICATIONS

D. Satyanarayana and P.R. Chatterji, "Biodegradable Polymers: Challenges and Strategies", JMS—REV. *Macromol. Chem. Phys.*, C33(3), 349–368 (1993).

Y. Doi, Y. Kumagai, N. Tanahashi, and K. Mukai, "Structural Effects on Biodegradation of Microbial and Synthetic Poly(hydroxyalkanoates)", *Biodegradable Polymers and Plastics*, The Royal Society of Chemistry, pp. 139–138.

"Degradable PP–Fibers", *Research Disclosure*, Mar. 1992, pp. 196–197.

*Encyclopedia of Polymer Science and Engineering*, vol. 13, (1988), pp. 485–491, John Wiley & Sons, New York, NY.

Periodical Table of the Elements from *CRC Handbook of Chemistry and Physics*, 61st ed. (1980), CRC Press, Boca Raton, Florida.

*Primary Examiner*—Newton Edwards

*Attorney, Agent, or Firm*—Carolyn A. Bates; Robert W. Sprague; Stephen W. Bauer

[57] ABSTRACT

Degradable multilayer melt blown microfibers are provided. The fibers comprise (a) at least one layer of polyolefin resin and at least one layer of polycaprolactone resin, at least one of the polyolefin or polycaprolactone resins containing a transition metal salt; or (b) at least one layer of polyolefin resin containing a transition metal salt and at least one layer of a degradable resin or transition metal salt-free polyolefin resin. Also provided is a degradable web comprising the multilayer melt blown microfibers.

23 Claims, 3 Drawing Sheets

DEGRADABLE MULTILAYER MELT BLOWN MICROFIBERS

FIELD OF THE INVENTION

The present invention relates to degradable multilayer melt blown microfibers which, in web form, are useful, for example, in wipes, sorbents, tape backings, release liners, filtration media, insulation media, surgical gowns and drapes and wound dressings.

BACKGROUND OF THE INVENTION

Numerous attempts have been made to enhance the degradability of conventional non-degradable polymers such as polyolefins by the use of additive systems. These additive systems are frequently designed to enhance the polymers degradability in a specific type of environment. For example, ferric stearate with various free fatty acids and manganese stearate with stearic acid have been suggested as suitable systems for providing degradability in polyolefin materials in the presence of ultraviolet radiation. Addition of a biodegradable polymer such as poly(caprolactone) has been suggested for improving degradability of polyolefins in a soil environment.

It has also been suggested that addition of a starch, an iron compound and a fatty acid or fatty acid ester can cause poly(ethylene) to degrade when exposed to heat, ultraviolet radiation or under composting conditions. It has further been suggested that compostable polyolefins can be prepared by the addition of a transition metal salt selected from cobalt, manganese, copper, cerium, vanadium and iron, and a fatty acid or ester having 10 to 22 carbon atoms providing unsaturated species and free acid. Although various systems have been suggested, improvements in degrading polymeric materials, particularly polyolefins, continue to be sought.

SUMMARY OF THE INVENTION

The present invention provides multilayer melt blown microfibers comprising (a) at least one layer of polyolefin resin and at least one layer of polycaprolactone resin, at least one of the polyolefin or polycaprolactone resins containing a transition metal salt; or (b) at least one layer of polyolefin resin containing a transition metal salt and at least one layer of a degradable resin or transition metal salt-free polyolefin resin. The degradable resins may be, for example, biodegradable, compostable, hydrolyzable or water soluble. In preferred embodiments of the invention, the polyolefin, in addition to the transition metal salt, may contain a fatty acid, fatty acid ester or combinations thereof which performs as an auto-oxidant, i.e., enhances oxidative degradation.

Surprisingly, the multilayer melt blown microfibers of the present invention degraded to a greater extent than would be expected from the degradation potential of each the fiber components. This more rapid degradation generally occurs regardless of the location of the transition metal salt or the optional fatty acid or fatty acid ester in the layers. The multilayer melt blown microfibers of the present invention degrade well in moist, biologically active environments such as compost, where the biodegradable, water soluble, or compostable polymer layers of the microfiber erode and thus expose the remaining degradable polyolefin, yet prior to such exposure, the degradable polymer protects against premature oxidation of the polyolefin layers.

The present invention further provides a web comprising multilayer melt blown microfibers comprising (a) at least one layer of polyolefin resin and at least one layer of polycaprolactone resin, at least one of the polyolefin or polycaprolactone resins containing a transition metal salt; or (b) at least one layer of polyolefin resin containing a transition metal salt and at least one layer of a degradable resin or transition metal salt-free polyolefin resin. The web may degrade to embrittlement within about 14 days at a temperature of 60° C. and a relative humidity of at least 80%.

DETAILED DESCRIPTION OF THE INVENTION

Figure 1:
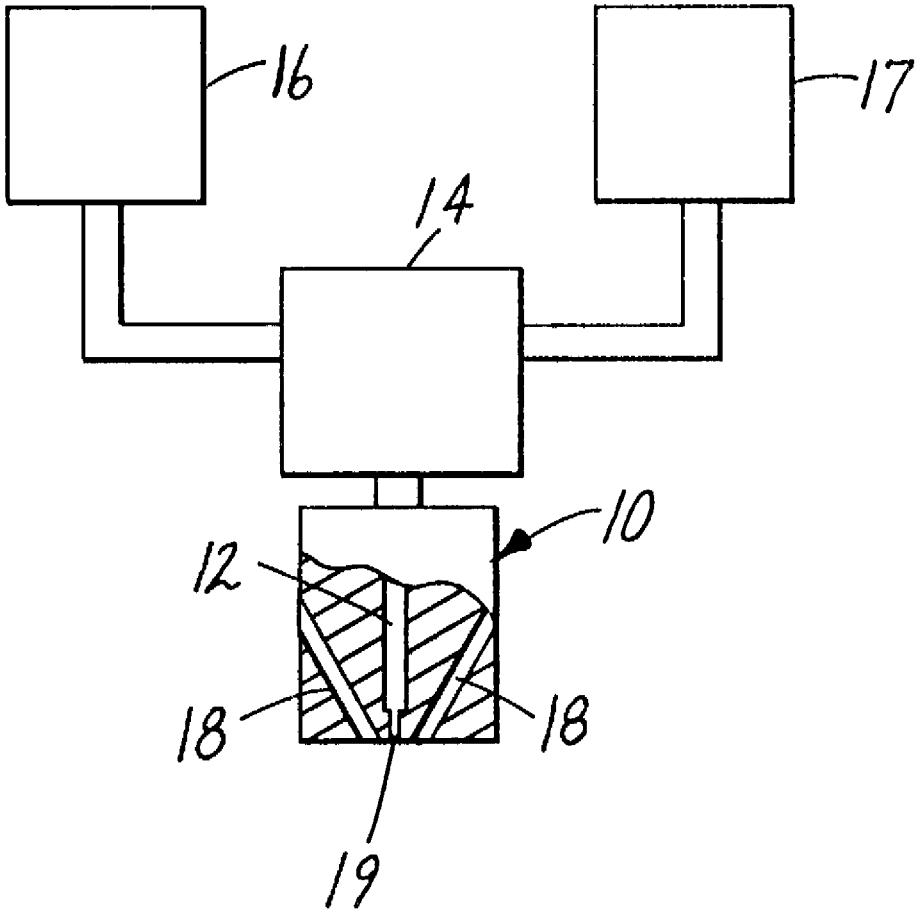
FIG. 1 is a top view of an apparatus useful in preparing the multilayer melt blown microfibers of the present invention.

Polyolefin resins, or polyolefins, useful in the present invention include poly(ethylene), poly(propylene), copolymers of ethylene and propylene, poly(butylene), poly(4-methyl-1-pentene), and combinations thereof.

The degradable resin may be, for example, biodegradable, compostable, hydrolyzable or water soluble. Examples of biodegradable resins include poly(caprolactone), poly (hydroxybutyrate), poly(hydroxybutyrate-valerate), and related poly(hydroxyalkanoates), poly(vinyl alcohol), poly (ethylene oxide) and plasticized carbohydrates such as starch and pullulan. Examples of compostable resins include modified poly(ethylene terephthalate), e.g., Experimental Resin Lot No. 9743, available from E. I. duPont de Nemours and Company, Wilmington, Del., and extrudable starch-based resins such as Mater-Bi™, available from Novamont S.p.A., Novara, Italy. Examples of hydrolyzable resins include poly(lactic acid), cellulose esters, such as cellulose acetates and propionates, hydrolytically sensitive polyesters such as Earthguard™ Lot No. 930210 (experimental), available from Polymer Chemistry Innovations, State College, Pa., polyesteramides, and polyurethanes. Water soluble resins include poly(vinyl alcohol), poly(acrylic acid), and Kodak™ AQ (experimental polyester), available from Kodak Chemical Co., Rochester, N.Y. Additionally, copolymers of poly(vinyl alcohol) with a polyolefin, e.g., poly (ethylene vinyl alcohol) or poly(vinyl acetate) both of which are less readily soluble in water, but biodegradable, may be useful degradable resins.

The transition metal salts which can be added to the polyolefin or, in some aspects of the invention to poly (caprolactone), include those discussed, for example, in U.S. Pat. No. 4,067,836 (Potts et al.), which is incorporated herein by reference. These salts can be those having organic or inorganic ligands. Suitable inorganic ligands include chlorides, nitrates, sulfates, and the like. Preferred are organic ligands such as octanoates, acetates, stearates, oleates, naphthenates, linoleates, tallates and the like. Although a wide range of transition metals have been disclosed in the art as suitable for various degradant systems, in the present invention it is preferred that the transition metal be selected from cobalt, manganese, copper, cerium, vanadium and iron, more preferably cobalt, manganese, iron and cerium. The transition metal is preferably present in a concentration range of from 5 to 500 ppm, more preferably from 5 to 200 ppm which is highly desirable as such metals are generally undesirable in large concentrations. High transition metal concentrations in the polyolefin or poly (caprolactone) can lead to toxicological and environmental concerns due to groundwater leaching of these metals into the surrounding environment. Further, higher transition metal concentrations can yield fibers which degrade so rapidly that storage stability may be a problem.

The optional fatty acid or fatty acid ester is preferably present in the polymer composition at a concentration of about 0.1 to 10 weight percent. The fatty acid, when present, preferably is present in sufficient concentration to provide a concentration of free acid species greater than 0.1 percent by weight based on the total composition. The fatty acid ester, when present, is preferably present in a concentration sufficient to provide a concentration of unsaturated species of greater than 0.1 weight percent. Preferably, the fatty acid, fatty acid ester or combinations thereof, when present, are present in sufficient concentration to provide a concentration of free acid species greater than 0.1 percent by weight and a concentration of unsaturated species of greater than 0.1 weight percent based on the total composition. Generally, it is preferred that the composition will have to be shelf-stable for at least 2 weeks, more preferably from 2 to 12 months. As degradation occurs slowly, even at room temperature for some embodiments of the invention, for longer shelf-life products, generally lower concentrations of the transition metal or fatty acid (free acid and/or unsaturated species) will be required to provide a fiber web at the intended mean shelf life of the web. Conversely, higher concentrations of the metal or fatty acid species will be required for fibers with short-intended shelf lives.

It is found that adequate degradation under typical composting conditions requires salts of the above-mentioned transition metals in combination with acid moieties such as those found in unsaturated fatty acids. It is also found that unsaturation in the fatty acid, or an admixed fatty acid ester or natural oil, is required to produce adequate degradation with the proper transition metal compound. Preferably, this unsaturated fatty acid is present in the polymer composition at concentrations of at least 0.1 weight percent of the composition. Also suitable are blends of fatty acids and fatty acid esters or oils as long as the amount of free acid and unsaturated species are generally equivalent to the above-described ranges for a pure fatty acid containing composition.

Generally, it is found that unsaturated fatty acids and fatty acid esters having 10 to 22 carbon atoms function well in providing the degradation rate required for a compostable material. Such materials include, for example, oleic acid, linoleic acid and linolenic acid; eleostearic acid, found in high concentration in the ester form, in natural tung oil; linseed oil, and fish oils such as sardine, cod liver, menhaden, and herring oil.

The preferred process for preparing the fibers of the invention is described in U.S. Pat. No. 5,207,970 (Joseph et al.) which is incorporated herein by reference. The process utilized the apparatus shown in FIG. 1 wherein the polymeric components are introduced into the die cavity 12 of die 10 from a separate splitter, splitter region or combining manifold 14 and into the, e.g., splitter from extruders, such as 16 and 17. Gear pumps and/or purgeblocks can also be used to finely control the polymer flow rate. In the splitter or combining manifold, the separate polymeric component flowstreams are formed into a single layered flowstream. However, preferably, the separate flowstreams are kept out of direct contact for as long a period as possible prior to reaching the die 10.

The split or separate flowstreams are combined only immediately prior to reaching the die, or die orifices. This minimized the possibility of flow instabilities generating in the separate flowstreams after being combined in the single layered flow stream, which tends to result in non-uniform and discontinuous longitudinal layer in the multi-layered microfibers.

From die cavity 12, the multi-layer polymer flowstream is extruded through an array of side-by-side orifices 19. Prior to this extrusion, the feed can be formed into the appropriate profile in the cavity 12, suitably by use of a conventional coathanger transition piece. Air slots 18, or the like, are disposed on either side of the row of orifices 19 for directing uniform heated air at high velocity at the extruded layered melt streams. The air temperature is generally about that of the meltstream, although preferably 20° C. to 30° C. higher than the polymer melt temperature. This hot, high-velocity air draws out and attenuates the extruded polymeric material, which will generally solidify after traveling a relatively short distance from die 10. The solidified or partially solidified fibers are then formed into a web by known methods and collected.

The following examples further illustrate this invention, but the particular materials and amounts thereof in these examples, as well as the conditions and details, should not be construed to unduly limit this invention. In the examples, all parts and percentages are by weight unless otherwise specified. In the examples the following test procedures were used.

A 10×10 centimeter (cm) sample was cut from the microfiber web and weighed to the nearest ±0.001 g. The weight was multiplied by 100 and reported as basis weight in $g/m^2$.

Embrittlement Test

Web samples were hand tested for embrittlement after aging in forced air ovens at 49° C., 60° C. and 70° C. in intervals of 12 to 24 hours. A state of embrittlement was defined as the time at which the web samples had little or no tear or tensile strength remaining or would crumble when folded. With softer or lower melting polymers, such as poly(caprolactone), the sample webs did not generally disintegrate or crumble but rather became stiff and lost tensile strength. Compost conditions were simulated by placing the web samples into a jar of water which was buffered to a pH of 6 by a phosphate buffer and heated to 60° C. and these web samples were tested for embrittlement at intervals of 30 to 50 hours. Additionally, web samples were removed from the water jars at regular time intervals and measured for weight loss.

Weight Loss Test

Web samples (5 cm×5 cm) were preweighed to the nearest ±0.0001 g. The web samples were placed in a forced air oven at 60° C. or 93° C. and removed at regular time intervals and measured for weight loss.

Compost Simulation Test

A mixture of the following was prepared:

445 g shredded maple leaves 180 g shredded paper (50:50 news:computer)

75 g meat waste (1:1 mix of dry Cat Chow™ and dry Dog Chow™ from the Ralston Purina Company, St. Louis, Mo.

200 g food waste (frozen mixed vegetables, commercial blend of peas, green beans, carrots and corn)

13.5 g Compost Plus (from Ringer Corporation, Minneapolis, Minn.

60 g dehydrated cow manure 900 mL water 6 g urea

The entire mixture was placed in a 22.7 liter (L) rectangular (35.6 cm×25.4 cm×25.4 cm) Nalgene poly(propylene) tank with a cover (from The entire mixture was placed in a 22.7 liter (L) rectangular (35.6 cm×25.4 cm×25.4 cm) Nalgene poly(propylene) tank with a cover (from Fisher Scientific Co., St. Louis, Mo.). Moist air was run through the compost mixture at a rate of 15 mL/minute by dispersing the air through water with a coarse glass frit (25.4 cm×3.8 cm) and then into the bottom of the compost tank through a perforated stainless steel tube. Microfiber webs were cut into 5 cm×5 cm squares and labeled so that web samples were designated for removal at predetermined time intervals. If weight loss was to be determined, the web samples were preweighed. Web samples (10–15) were placed evenly throughout the compost mixture and the tank was covered to minimize loss of moisture. The tank was placed into an oven at 55° C. Generally, after a period of four to ten days, additional water was added to give 60 weight percent water.

Approximately every two days, the condition of the compost and the web samples was checked. The web samples were pulled and folded to determine any changes in strength or brittleness. Web samples were duplicated in different tanks. Web samples were typically removed at predetermined intervals of 10, 20, 30, and 45 days and cleaned by gently washing in water, dried, and weighed. The percent weight change was determined.

The condition of the compost was determined by measuring the pH, percent moisture, and temperature. The initial pH was typically in the range of 4.5–5.5 and increased slowly over the test period to the range of 7.5–8.5, with the average pH over the test period being 6.8 to 8.0. Percent water was maintained at approximately 60% by the careful addition of water as needed. Average percent water recorded was in the range of 50–65% by weight. The temperature of the compost increased during the first two weeks of operation due to the high level of microbiological activity during that time period. After that the temperature of the compost was maintained at the oven temperature of 55° C. with average temperatures over the life of the test ranging from 53°–62° C. The test period was from 45–60 days.

Tensile Modulus and Percent Strain at Break

Tensile modulus data on the multi-layer microfiber webs was obtained according to ASTM D882-91 "Standard Test Method for Tensile Properties of Thin Plastic Sheeting" using an Instron Tensile Tester (Model 1122), Instron Corporation, Canton, Mass. with a 10.48 cm jaw gap and a crosshead speed of 25.4 cm/min. Web samples were 2.54 cm in width.

BLOWN MICROFIBER WEB PREPARATION

Examples 1–11

The multi-layered blown microfiber webs of the present invention were prepared using a melt-blowing process as described in U.S. Pat. No. 5,207,970 (Joseph et al.) which is incorporated herein by reference. The process used a melt-blowing die having circular smooth surfaced orifices (10/cm) with a 5:1 length to diameter ratio.

The microfiber webs were prepared using the amount and type of metal stearate and the amount and type of auto-oxidant as shown in Table 1. The powdered metal stearate and/or oily auto-oxidants were added to the polymer resins in a mixer with a mixing blade driven by an electric motor to control the speed of mixing. The mixture of metal stearate/auto-oxidant/resin, metal stearate/resin, or auto-oxidant/resin was placed in the hopper of the first or second extruder depending on whether the mixture was used in Polymer 1 or Polymer 2 or both. The first extruder (210° C.) delivered a melt stream of a 800 melt flow rate (MFR) poly(propylene) (PP) resin (PP 3495G, available from Exxon Chemical Corp., Houston, Tex.) mixture to the feedblock assembly which was heated to about 210° C. The second extruder, which was also maintained at about 210° C., delivered a melt stream of a poly(caprolactone) (PCL) resin (Tone™ 767P, available from Union Carbide, Danbury, Conn.) to the feedblock. The feedblock split the two melt streams. The polymer melt streams were merged in an alternating fashion into a five-layer melt stream on exiting the feedblock, with the inner layers being the poly (propylene) resin. The gear pumps were adjusted so that the pump ratio of polymer 1:polymer 2 was delivered to the feedblock assembly as given in Table 1. A 0.14 kg/hr/cm die width polymer throughput rate was maintained at the die (210° C.). The primary air temperature was maintained at approximately 209° C. and at a pressure suitable to produce a uniform web with a 0.076 cm gap. Webs were collected at a collector to die distance of 26.7 cm. The resulting microfiber webs, comprising five-layer microfibers having an average diameter of less than about 10 micrometers, had a basis weight of about 100 g/m$^2$.

The embrittlement test was performed on microfiber webs of Examples 1–11 and the results are reported in Table 2. Weight loss after 300 hours of aging at 60° C. in an oven as well as the weight average molecular weight ($M_w$) and the number average molecular weight ($M_n$) after such aging conditions at various intervals were determined for the microfiber webs of Examples 5, 9b, and 11 and are reported in Table 3. The weight loss for Examples 4, 10, and 11 after various time intervals of being in water (pH=6.0) at 60° C. as described in the Embrittlement Test are reported in Table 4. The weight loss for microfiber webs of Examples 4, 10, and 11 after being subjected to the Compost Simulation Test are reported in Table 5. Initial modulus and percent strain at break were determined for microfiber webs of Examples 1–11 and the results are reported in Table 6.

Control Web I

A control web of the 800 MFR polypropylene resin was prepared according to the procedure of Examples 1–11, except that only one extruder, which was maintained at 220° C., was used, and it was connected directly to the die through a gear pump. The die and air temperatures were maintained at 220° C. The resulting microfiber web had a basis weight 100 g/m$^2$ and an average fiber diameter of less than about 10 micrometers.

The weight loss after 300 hours of aging at 60° C. in an oven and the weight average molecular weight ($M_w$) and the number average molecular weight ($M_n$) after such aging conditions at various intervals were determined and are reported in Table 3.

Control Web II

A control web of the polypropylene resin and the poly (caprolactone) resin was prepared according to the procedure of Examples 1–11. The die and air temperatures were maintained at 220° C. The resulting microfiber web had a basis weight of 102 g/m$^2$ and an average fiber diameter of less than about 10 micrometers.

The microfiber web was tested for embrittlement and for initial modulus and percent strain at break. The results are reported in Tables 2 and 6, respectively.

Comparative Examples A–C

Three comparative microfiber webs of the polypropylene resin and the poly(caprolactone) resin without the metal stearate were prepared according to the procedure of Examples 1–11. The amount and type of auto-oxidant are set forth in Table 1. The resulting microfiber webs had a basis weight 102 g/m$^2$ and an average fiber diameter of less than about 10 micrometers.

The microfiber webs were tested for embrittlement and for initial modulus and percent strain at break. The results are reported in Tables 2 and 6, respectively.

Comparative Examples D–F

Three comparative microfiber webs of the polypropylene resin with or without the auto-oxidant were prepared according to the procedure of Examples 1–11 as modified in the procedure of Control I for using one extruder. The amounts and types of metal stearate and auto-oxidant are given in Table 1. The resulting microfiber webs had basis weights of 97, 102, and 104 g/m$^2$, respectively, and an average fiber diameter of less than about 10 micrometers.

The weight loss after 300 hours of aging at 60° C. in an oven and the weight average molecular weight ($M_w$) and the number average molecular weight ($M_n$) after such aging conditions at various intervals are set forth in Table 3.

Comparative Examples G–H

Two comparative microfiber webs of the poly (caprolactone) resin with two types of metal stearate and an auto-oxidant were prepared according to the procedure of Examples 1–11 as modified in the procedure of Control I for using one extruder. The amounts and types of metal stearate and auto-oxidant are given in Table 1. The resulting microfiber webs had a basis weight of 100 g/m$^2$ and an average fiber diameter of less than about 10 micrometers.

The weight loss after 300 hours of aging at 60° C. in an oven and the weight average molecular weight ($M_w$) and the number average molecular weight ($M_n$) after such aging conditions at various intervals for the microfiber webs are reported in Table 3.

Example 12

A microfiber web having a basis weight of 96 g/m$^2$ and comprising five-layer microfibers having an average diameter of less than about 10 micrometers was prepared according to the procedure of Examples 1–11, except that polypropylene resin without metal stearate and auto-oxidant was substituted for the poly(caprolactone) resin in the second extruder.

The microfiber web was tested for embrittlement with the results reported in Table 2. The weight loss after 300 hours of aging at 60° C. in an oven and the weight average molecular weight ($M_w$) and the number average molecular weight ($M_n$) after such aging conditions at various intervals were determined and are reported in Table 3. The weight loss after various time intervals of being in water (pH=6.0) at 60° C. as described in the embrittlement test was determined and is reported in Table 4. The web was evaluated for initial modulus and percent strain at break and the results are reported in Table 6.

Examples 13–14

Two microfiber webs having a basis weight of 110 g/m$^2$ and comprising five-layer microfibers having an average diameter of less than about 10 micrometers were prepared according to the procedure of Examples 1–11, except that a modified poly(ethylene terephthalate) (PET) (experimental resin lot # 9743 available from E. I. Du Pont de Nemours and Company, Wilmington, Del.) was substituted for the poly (caprolactone) resin in the second extruder.

The webs were tested for embrittlement with results reported in Table 2. The weight loss after 300 hours of aging at 60° C. in an oven and the weight average molecular weight ($M_w$) and the number average molecular weight ($M_n$) after such aging conditions at various intervals are set forth in Table 3. The weight loss after various time intervals of being in water (pH=6.0) at 60° C. as described in the Embrittlement Test are reported in Table 4. The weight loss of the web of Example 13 after being subjected to the Composting Simulation Test is reported in Table 5. The webs of Examples 13–14 were evaluated for initial modulus and percent strain at break and the results are set forth in Table 6.

Comparative Example I

A comparative microfiber web of the modified poly (ethylene terephthalate) used in Examples 13 and 14 with a metal stearate and an auto-oxidant was prepared according to the procedure of Examples 1–11 as modified by the procedure in Control I for using one extruder. The amount of cobalt stearate and oleic acid used are set forth in Table 1. The resulting microfiber webs had a basis weight of 137 g/m$^2$ and an average fiber diameter of less than about 10 micrometers.

The weight loss after 300 hours of aging at 60° C. in an oven is reported in Table 3.

Example 15

A microfiber web having a basis weight of 107 g/m$^2$ and comprising five-layer microfibers having an average diameter of less than about 10 micrometers was prepared according to the procedure of Examples 1–11, except that an experimental hydrolyzable polyester (PEH) (Kodak™AQ available from Kodak Chemical Co., Rochester, N.Y.) was substituted for the poly(caprolactone) resin in the second extruder.

The microfiber web was tested for embrittlement with the results set forth in Table 2. The weight loss after 300 hours of aging at 60° C. in an oven and the weight average molecular weight ($M_w$) and the number average molecular weight ($M_n$) after such aging conditions at various intervals are reported in Table 3. The weight loss after various time intervals of being in water (pH=6.0) at 60° C. as described in the Embrittlement Test is reported in Table 4. The weight loss after being subjected to the Composting Simulation Test is reported in Table 5. The microfiber web was evaluated for initial modulus and percent strain at break and the results are reported in Table 6.

Examples 16–17

Two microfiber webs having a basis weight of 107 g/m$^2$ and comprising five-layer microfibers having an average diameter of less than about 10 micrometers were prepared according to the procedure of Examples 1–11, except that a polyurethane (PUR) resin (PE90-200 available from Morton International, Seabrook, N.H.) was substituted for the poly (caprolactone) resin in the second extruder.

The webs were tested for embrittlement and the results are reported in Table 2. The weight loss after 300 hours of aging at 60° C. in an oven and the weight average molecular weight ($M_w$) and the number average molecular weight ($M_n$) after such aging conditions at various intervals are reported in Table 3. The weight loss after various time intervals of being in water (pH=6.0) at 60° C. as described in the Embrittlement Test is reported in Table 4. The weight loss for Example 16 after being subjected to the Composting Simulation Test is reported in Table 5. The webs were also evaluated for initial modulus and percent strain at break and the results are reported in Table 6.

Comparative Examples J–K

Two comparative microfiber webs of the polyurethane resin used in Examples 16 and 17 with two types of metal stearate and an auto-oxidant were prepared according to the procedure of Examples 1–11 as modified in the procedure of Control I for using one extruder. The amounts and types of metal stearate and auto-oxidant are set forth in Table 1. The resulting microfiber webs had a basis weight of 74 g/m$^2$ and an average fiber diameter of less than about 10 micrometers.

The weight loss after 300 hours of aging at 60° C. in an oven and the weight average molecular weight ($M_w$) and the number average molecular weight ($M_n$) after such aging conditions at various intervals are reported in Table 3.

Examples 18–19

Two microfiber webs having a basis weight of 107 g/m$^2$ and comprising five-layer microfibers having an average diameter of less than about 10 micrometers were prepared according to the procedure of Examples 1–11, except that a poly(vinyl alcohol) (PVOH) resin (Vinex™2019 available from Air Products and Chemicals, Allentown, Pa.) was substituted for the poly(caprolactone) resin in the second extruder. The amounts of manganese stearate and oleic acid are set forth in Table 1.

Figure 2:
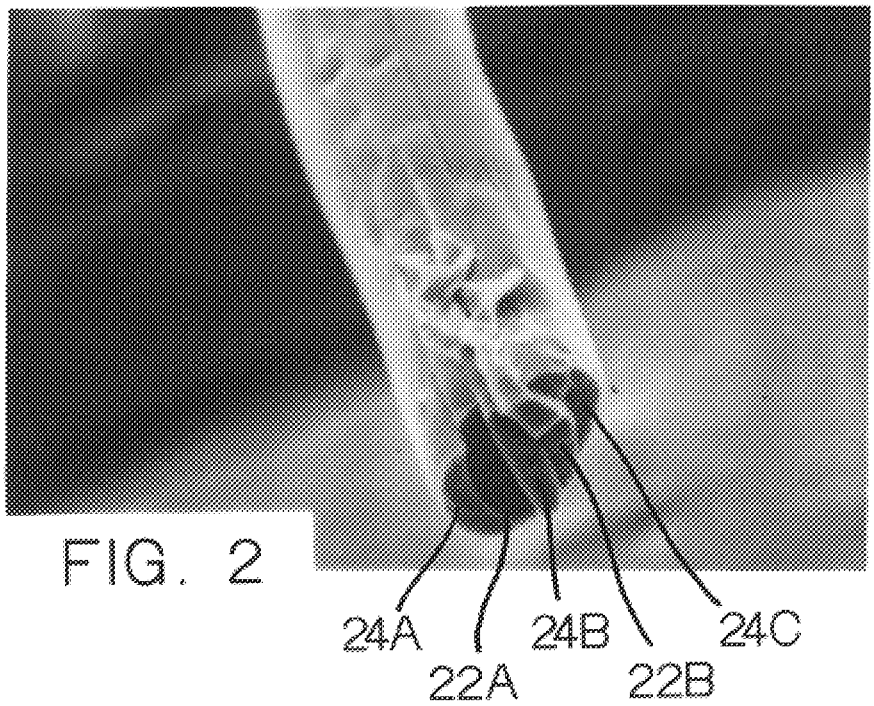
FIG. 2 is a microphotograph of a five-layer microfiber of the present invention at 2000× as produced.
Figure 3:
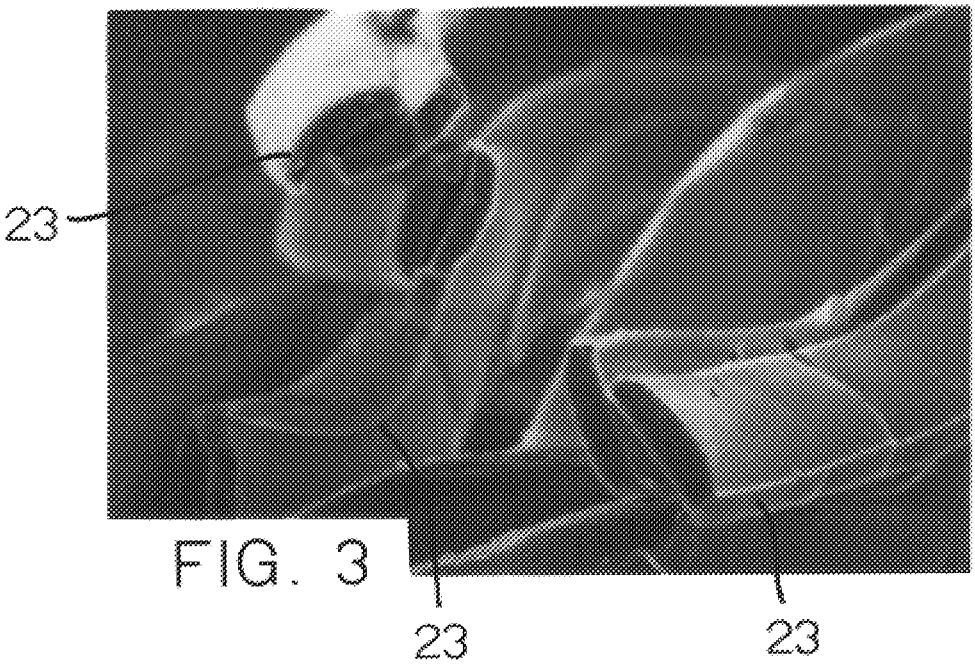
FIG. 3 is a microphotograph of the microfiber of FIG. 2 after 10 days exposure to compost conditions.

The microfibers of Example 18 are shown in FIGS. 2 and 3. FIG. 2 shows a five-layer microfiber 20 containing degradable poly(propylene) layers 22A and 22B and poly (vinyl alcohol) layers, 24A, 24B and 24C as extruded at 2000X magnification. FIG. 3 shows the result of subjecting fiber 20 to the Compost Simulation Test for 10 days at a magnification of 2000X. The water soluble, biodegradable layers have eroded, leaving dispersed and exposed degradable polyolefin fibers 23.

The microfiber webs were subjected to the Embrittlement Test and the results are set forth in Table 2. The weight loss after 300 hours of aging at 60° C. in an oven and the weight average molecular weight ($M_w$) and the number average molecular weight ($M_n$) for the webs after such aging conditions at various intervals are reported in Table 3. The weight loss after various time intervals of being in water (pH=6.0) at 60° C. as described in the Embrittlement Test is reported in Table 4. The weight loss for Example 18 after being subjected to the Composting Simulation Test is reported in Table 5. The webs were evaluated for initial modulus and percent strain at break and the results are set forth in Table 6.

Comparative Examples L–M

Two comparative microfiber webs of the poly(vinyl alcohol) resin used in Examples 18–19 with two types of metal stearate and an auto-oxidant were prepared according to the procedure of Examples 1–11 as modified in the procedure of Control I for using one extruder. The amounts and types of metal stearate and auto-oxidant are given in Table 1. The resulting microfiber webs had a basis weight of 148 and 140 g/m$^2$, respectively, and an average fiber diameter of less than about 10 micrometers.

The weight loss after 300 hours of aging at 60° C. in an oven and the weight average molecular weight ($M_w$) and the number average molecular weight ($M_n$) after such aging conditions at various intervals are set forth in Table 3.

Examples 20–21

Two microfiber webs having a basis weight of

107g/m$^2$ and comprising five-layer microfibers having an average diameter of less than about 10 micrometers were prepared according to the procedure of Examples 1–11, except that a poly(lactic acid) (PLA) resin (ECOPLA™, Experimental resin lot # DVD 98, available from Cargill, Inc., Minneapolis, Minn.) was substituted for the poly (caprolactone) resin in the second extruder.

The microfiber webs were subjected to the Embrittlement Test with the results reported in Table 2. The weight loss after 300 hours of aging at 60° C. in an oven and the weight average molecular weight ($M_w$) and the number average molecular weight ($M_n$) after such aging conditions at various intervals are reported in Table 3. The weight loss after various time intervals of being in water (pH=6.0) at 60° C. as described above in the Embrittlement Test is given in Table 4. The weight loss of the webs after being subjected to the Composting Simulation Test is reported in Table 5. The webs were evaluated for initial modulus and percent strain at break and the results are given in Table 6.

Comparative Example N

One comparative microfiber web of the poly(lactic acid) resin used in Examples 20–21 with cobalt stearate and oleic acid was prepared according to the procedure of Examples 1–11 as modified in the procedure of Control I for using one extruder. The amount the metal stearate and auto-oxidant are given in Table 1. The resulting microfiber web had a basis weight of 158 g/m$^2$ and an average fiber diameter of less than about 10 micrometers.

The weight loss after 300 hours of aging at 60° C. in an oven and the weight average molecular weight ($M_w$) and the number average molecular weight ($M_n$) after such aging conditions at various intervals are set forth in Table 3.

Examples 22–23

Two microfiber webs having a basis weight of 96 g/m$^2$ and comprising five-layer microfibers having an average diameter of less than about 10 micrometers were prepared according to the procedure of Examples 1–11, except that a poly(hydroxybutyrate-co-valerate) (18% valerate) (PHBV) resin (PHBV-18, available from Zeneca Bioproducts, New Castle, Del.) was substituted for the poly(caprolactone) resin in the second extruder.

Figure 4:
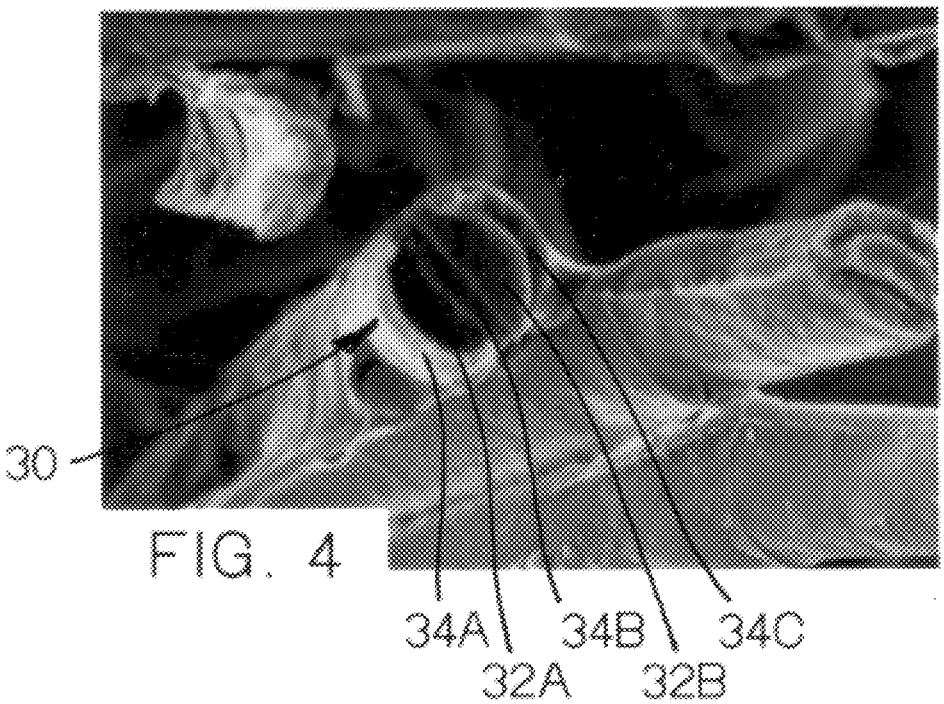
FIG. 4 is a microphotograph of another five-layer microfiber of the present invention at 2500× as produced.
Figure 5:
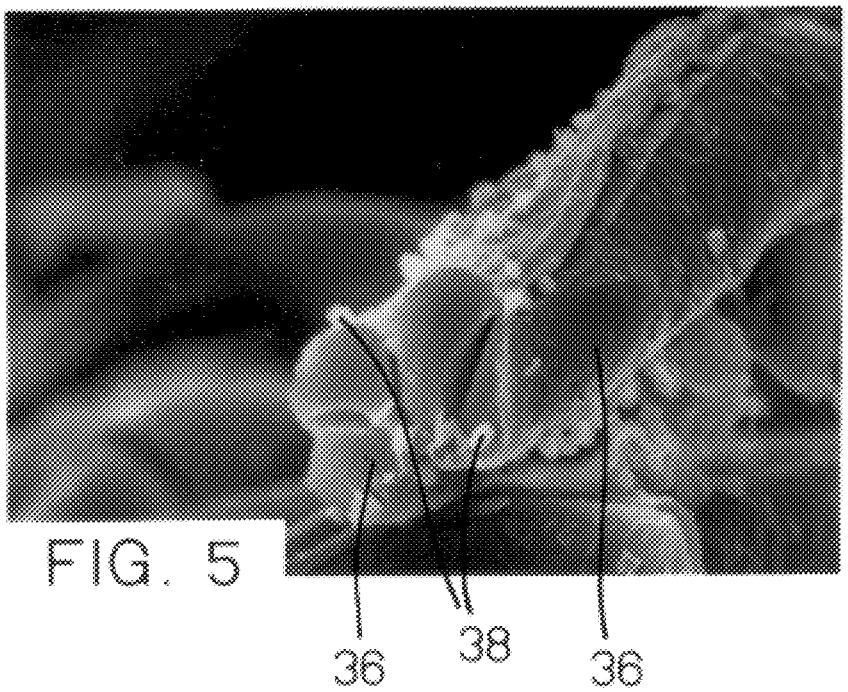
FIG. 5 is a microphotograph of the microfiber of FIG. 4 after 45 days exposure to compost conditions.

The microfibers of Example 22 are shown in FIGS. 4 and 5. FIG. 4 shows the five-layer microfibers 30 at 2500× magnification containing degradable poly(propylene) layers 32A and 32B and poly(hydroxybutyrate-valerate) layers 34A, 34B and 34C as initially formed. FIG. 5 shows the microfibers 30 of Example 22 after being subjected to the Compost Simulation Test for 45 days at a magnification of 2500×. The biodegradable layers have eroded, leaving exposed degradable polyolefin fibers 36. Microorganisms 38 which may have aided degradation of the fiber are seen attached to the fiber.

The webs were subjected to the Embrittlement Test and the results are set forth in Table 2. The weight loss after 300 hours of aging at 60° C. in an oven and the weight average molecular weight ($M_w$) and the number average molecular weight ($M_n$) after such aging conditions at various intervals are given in Table 3. The weight loss after various time intervals of being in water (pH=6.0) at 60° C. as described in the Embrittlement Test is given in Table 4. The weight loss of the webs after being subjected to the Composting Simulation Test is set forth in Table 5. The webs were evaluated for initial modulus and percent strain at break and the results are reported in Table 6.

Examples 24–25

Two microfiber webs having a basis weight of 114 and 102 g/m$^2$, respectively, and comprising five-layer microfibers having an average diameter of less than about 10 micrometers were prepared according to the procedure of Examples 1–11, except that a hydrolyzable polyester (PES) (Earthguard™, experimental resin lot #930210 available from Polymer Chemistry Innovations, State College, Pa.) was substituted for the poly(caprolactone) resin in the second extruder.

The microfiber webs were subjected to the Embrittlement Test and the results are reported in Table 2. The weight loss after 300 hours of aging at 60° C. in an oven and the weight average molecular weight ($M_w$) and the number average molecular weight ($M_n$) after such aging conditions at various intervals are reported in Table 3. The weight loss after various time intervals of being in water (pH=6.0) at 60° C. as described in the Embrittlement Test is set forth in Table 4.

The weight loss for Example 24 after being subjected to the Composting Simulation Test is reported in Table 5.

The webs were evaluated for initial modulus and percent strain at break and the results are given in Table 6.

TABLE 1

| | Composition | | | | | |
|---|---|---|---|---|---|---|
| | | Metal Stearate | | | | Pump Ratio |
| | Polymer 1 | Amount | | Auto-oxidant | | Polymer 1: |
| Ex. No. | (g) | (g) | Type | Amount (g) | Type | Polymer 2 |
| Control I | 500 | 0 | — | 0 | — | 100 PP:0 |
| Control II | 500 | 0 | — | 0 | — | 50 PP:50 PCL |
| Comp. A | 490 | 0 | — | 10 | oleic acid (OA) | 50 PP:50 PCL |
| Comp. B | 490 | 0 | — | 10 | tung oil (TO) | 50 PP:50 PCL |
| Comp. C | 490 | 0 | — | 10 | stearic acid(SA) | 50 PP:50 PCL |
| 1 | 498.58 | 1.42 | Mn | 0 | — | 50 PP:50 PCL |
| 2 | 498.58 | 1.42 | Co | 0 | — | 50 PP:50 PCL |
| 3 | 498.58 | 1.42 | Fe | 0 | — | 50 PP:50 PCL |
| Comp. D | 498.58 | 1.42 | Mn | 0 | — | 100 PP:0 |
| Comp. E | 488.58 | 1.42 | Mn | 10 | OA | 100 PP:0 |
| Comp. F | 488.58 | 1.42 | Co | 10 | OA | 100 PP:0 |
| 4 | 488.58 | 1.42 | Mn | 10 | OA | 50 PP:50 PCL |
| 5 | 478.58 | 1.42 | Mn | 20 | OA | 50 PP:50 PCL |
| 6 | 488.58 | 1.42 | Co | 10 | OA | 50 PP:50 PCL |
| 7 | 488.58 | 1.42 | Fe | 10 | OA | 50 PP:50 PCL |
| 8 | 488.58 | 1.42 | Mn | 10 | TO | 50 PP:50 PCL |
| 9a | 488.58 | 1.42 | Mn | 10 | SA | 50 PP:50 PCL |
| 9b | 488.58 | 1.42 | Mn | 10 | SA | 50 PP:50 PCL |
| 10 | 488.58 | 1.42 | Mn | 10 | OA | 25 PP:75 PCL |
| 11 | 488.58 | 1.42 | Mn | 10 | OA | 75 PP:25 PCL |
| Comp. G | 488.58 | 1.42 | Mn | 10 | OA | 100 PCL |
| Comp. H | 488.58 | 1.42 | Co | 10 | OA | 100 PCL |
| 12 | 488.58 | 1.42 | Mn | 10 | OA | 50 PP:50 PP |
| 13 | 488.58 | 1.42 | Mn | 10 | OA | 50 PP:50 PET |
| 14 | 488.58 | 1.42 | Mn | 10 | OA | 75 PP:25 PET |
| Comp. I | 488.58 | 1.42 | Co | 10 | OA | 100 PET |
| 15 | 488.58 | 1.42 | Mn | 10 | OA | 50 PP:50 PEH |
| 16 | 488.58 | 1.42 | Mn | 10 | OA | 50 PP:50 PUR |
| 17 | 488.58 | 1.42 | Mn | 10 | OA | 75 PP:25 PUR |
| Comp. J | 488.58 | 1.42 | Mn | 10 | OA | 100 PUR |
| Comp. K | 488.58 | 1.42 | Co | 10 | OA | 100 PUR |
| 18 | 488.58 | 1.42 | Mn | 10 | OA | 50 PP:50 PVOH |
| 19 | 488.58 | 1.42 | Mn | 10 | OA | 75 PP:25 PVOH |
| Comp. L | 488.58 | 1.42 | Mn | 10 | OA | 100 PVOH |
| Comp. M | 488.58 | 1.42 | Co | 10 | OA | 100 PVOH |
| 20 | 488.58 | 1.42 | Mn | 10 | OA | 50 PP:50 PLA |
| 21 | 488.58 | 1.42 | Mn | 10 | OA | 75 PP:25 PLA |
| Comp. N | 488.58 | 1.42 | Co | 10 | OA | 100 PLA |
| 22 | 488.58 | 1.42 | Mn | 10 | OA | 50 PP:50 PHBV |
| 23 | 488.58 | 1.42 | Mn | 10 | OA | 75 PP:25 PHBV |
| 24 | 488.58 | 1.42 | Mn | 10 | OA | 50 PP:50 PES |
| 25 | 488.58 | 1.42 | Mn | 10 | OA | 75 PP:25 PES |

TABLE 2

| | Hours to Embrittlement | | | | |
|---|---|---|---|---|---|
| | in an Oven | | | in Water | at Room Temp. |
| Ex. No. | 50° C. | 60° C. | 70° C. | 60° C. | 25° C. |
| Control II | >611 | 491 | 515 | NA | >700 |
| Comp. A | 491 | 165 | 76 | NA | >700 |
| Comp. B | >611 | 467 | 338 | NA | >700 |
| Comp. C | >611 | 491 | 443 | NA | >700 |
| 1 | 611 | 264 | 144 | NA | >700 |
| 2 | 361 | 168 | 76 | NA | >700 |
| 3 | >611 | 443 | 361 | NA | 692 |
| 4 | 338 | 50 | 50 | >500 | 504 |
| 5 | >611 | 50 | 32 | NA | 521 |
| 6 | 361 | 32 | 32 | NA | 504 |
| 7 | 443 | 264 | 168 | NA | 504 |
| 8 | 467 | 264 | 76 | NA | 692 |
| 9a | 443 | 192 | 76 | NA | 692 |
| 9b | 467 | 264 | 76 | NA | >700 |
| 10 | 611 | 288 | 76 | >500 | >700 |
| 11 | 168 | 32 | 9 | 100 | 364 |
| 12 | 32 | 24 | 24 | 200 | 409 |
| 13 | 317 | 317 | 168 | 100 | 432 |
| 14 | 443 | 361 | 338 | 150 | 521 |
| 15 | 77 | 24 | 24 | 300 | 409 |
| 16 | 96 | 32 | 32 | >500 | >700 |
| 17 | 32 | 24 | 24 | >500 | 504 |
| 18 | 443 | 338 | 317 | 50 | >700 |
| 19 | 317 | 317 | 317 | 50 | 692 |
| 20 | 77 | 24 | 24 | 150 | 409 |
| 21 | 77 | 24 | 24 | 50 | 409 |
| 22 | 77 | 32 | 32 | 300 | 409 |
| 23 | 24 | 10 | 9 | 100 | 364 |
| 24 | >500 | 491 | 467 | 300 | >700 |
| 25 | 338 | 317 | 264 | 150 | 504 |

As can be seen from the data in Table 2, the microfiber webs having the lowest embrittlement times were those containing both a metal stearate salt and an auto-oxidant. However, for webs containing only a metal stearate, the lowest embrittlement time was for Example 2 which contained cobalt stearate followed by Example 1 which contained manganese stearate and Example 3 which contained iron stearate, respectively. This trend in metal stearate activity, Co>Mn>Fe, was observed in each comparison.

Microfiber webs containing only an auto-oxidant are described in Comparative Examples A–C. These comparative examples demonstrated the improved ability of auto-oxidant containing both unsaturation and an acidic proton to effect the oxidative degradation of a polyolefin as compared as either unsaturation (tung oil) or an acidic proton (stearic acid) alone. The three materials, oleic acid (Comparative example A), tung oil (Comparative example B) and stearic acid (Comparative example C), are descriptive, but not exhaustive of the types of auto-oxidants found useful in this invention.

Examples with a composition (pump ratio) ratio of 50/50 poly(propylene)/Polymer 2 had slower embrittlement times than when Polymer 2 was also poly(propylene). However, many of these examples exhibited an embrittlement time thought to be acceptable for further evaluation, this being embrittlement times ≦336 hours at 60° C. in the Embrittlement Test described above. The fact that embrittlement of these examples did indeed occur was surprising since Polymer 2 was not expected to be subject to oxidative degradation except where Polymer 2 was poly(propylene) or polyurethane.

In general, as the composition ratios of the microfibers were changed from 25/75 to 50/50 to 75/25 poly(propylene) /Polymer 2, the embrittlement times in the oven were decreased at each temperature investigated due to the higher content of the readily oxidatively degradable component. The same trend was observed for the set of examples having composition ratios for the microfibers of 50/50 to 75/25 poly(propylene)/Polymer 2.

The results for embrittlement times in an oven could not be directly compared to the results in water, since several of the materials used as Polymer 2 were either water soluble and/or somewhat hydrolytically unstable. Both of these characteristics may be expected to influence the embrittlement of the microfiber webs to an unknown degree.

TABLE 3

| Example No. | Weight loss after 300 hours (%) | Time (hours) | Weight Average Molecular Weight ($M_w$) | Number Average Molecular Weight ($M_n$) |
|---|---|---|---|---|
| Control I | 1.74 | 0 | 110000 | 14600 |
| | | 50 | 113000 | 22500 |
| | | 150 | 131000 | 35800 |
| | | 315 | 119000 | 32700 |
| Comp. D | 8.73 | 0 | 142000 | 32200 |
| | | 50 | 126000 | 24800 |
| | | 150 | 5720 | 3180 |
| | | 315 | 2880 | 1960 |
| Comp. E | 11.33 | 0 | 134000 | 40600 |
| | | 50 | 9150 | 3390 |
| | | 150 | 3290 | 2220 |
| | | 315 | 2710 | 1980 |
| Comp. F | 7.20 | 0 | 35500 | 13300 |
| | | 50 | 6220 | 3360 |
| | | 150 | 3910 | 2490 |
| | | 315 | 8760 | 2190 |
| 5 | NA | 0 | 81400 | 24400 |
| | | 50 | 14100 | 4470 |
| | | 150 | 18000 | 4160 |
| | | 300 | 15100 | 4270 |
| 9b | NA | 0 | 78800 | 29300 |
| | | 50 | 24900 | 6700 |
| | | 150 | 22800 | 5010 |
| | | 300 | 18200 | 4520 |
| 11 | 5.5 | 0 | 120000 | 33800 |
| | | 50 | 9220 | 3500 |

TABLE 3-continued

| Example No. | Weight loss after 300 hours (%) | Time (hours) | Weight Average Molecular Weight ($M_w$) | Number Average Molecular Weight ($M_n$) |
|---|---|---|---|---|
| | | 150 | 45200 | 27000 |
| | | 300 | 7260 | 2770 |
| Comp. G | 2.54 | 0 | 91700 | 55800 |
| | | 50 | 78600 | 31600 |
| | | 150 | 77500 | 43600 |
| | | 315 | 71200 | 34000 |
| Comp. H | 1.49 | 0 | 66900 | 23100 |
| | | 50 | 54000 | 27300 |
| | | 150 | 44300 | 21000 |
| | | 315 | 58900 | 7280 |
| 12 | 1.2 | 0 | 120000 | 35400 |
| | | 50 | 7690 | 3620 |
| | | 150 | 5330 | 2830 |
| | | 300 | 4660 | 2890 |
| 13 | 0 | 0 | 107000 | 18900 |
| | | 50 | 4720 | 2890 |
| | | 150 | 4150 | 2630 |
| | | 300 | 3500 | 2420 |
| 14 | 0 | 0 | 123000 | 33700 |
| | | 50 | 4570 | 2830 |
| | | 150 | 3870 | 2410 |
| | | 300 | 3310 | 2470 |
| 15 | 10.3 | 0 | 129000 | 41300 |
| | | 50 | 5190 | 2840 |
| | | 150 | 3110 | 2250 |
| | | 300 | 3120 | 2120 |
| Comp. I | 1.33 | 0 | NA | NA |
| 16 | 0 | 0 | 95800 | 30200 |
| | | 50 | 5290 | 2710 |
| | | 150 | 4000 | 2500 |
| | | 300 | 4060 | 2630 |
| 17 | 0 | 0 | 119000 | 32200 |
| | | 50 | 5060 | 2860 |
| | | 150 | 4900 | 2770 |
| | | 300 | 4500 | 2610 |
| Comp. J | 11.44 | 0 | 37700 | 18600 |
| | | 50 | 6390 | 2460 |
| | | 150 | 4220 | 2100 |
| | | 315 | 5070 | 2140 |
| Comp. K | 3.87 | 0 | 25300 | 8510 |
| | | 50 | 6180 | 2600 |
| | | 150 | 6250 | 2470 |
| | | 315 | 8220 | 2670 |
| 18 | 55.8 | 0 | 109000 | 42200 |
| | | 50 | 35800 | 5310 |
| | | 150 | 5900 | 3000 |
| | | 300 | 3560 | 2530 |
| 19 | 38.5 | 0 | 95800 | 30400 |
| | | 50 | 5810 | 3080 |
| | | 150 | 5590 | 2960 |
| | | 300 | 3650 | 2360 |
| Comp. L | 12.11 | 0 | 14700 | 4850 |
| | | 50 | 14900 | 4870 |
| | | 150 | 14700 | 5080 |
| | | 315 | 15100 | 5100 |
| Comp. M | 12.41 | 0 | 14600 | 5010 |
| | | 50 | 14700 | 5160 |
| | | 150 | 14900 | 5120 |
| | | 315 | 14900 | 5190 |
| 20 | 9.5 | 0 | 55800 | 13200 |
| | | 50 | 18000 | 5760 |
| | | 150 | 16000 | 4980 |
| | | 300 | 12600 | 4340 |
| 21 | 11.4 | 0 | 115000 | 28300 |
| | | 50 | 9350 | 4280 |
| | | 150 | 8940 | 3470 |
| | | 300 | 6710 | 3080 |
| Comp. N | 2.41 | 0 | 31800 | 10300 |
| | | 50 | 33300 | 15100 |
| | | 150 | 28800 | 11600 |
| | | 315 | 29100 | 13400 |
| 22 | 0 | 0 | 103000 | 44800 |
| | | 50 | 4760 | 2840 |
| | | 150 | 3770 | 2370 |
| | | 300 | 3590 | 2210 |

TABLE 3-continued

| Example No. | Weight loss after 300 hours (%) | Time (hours) | Weight Average Molecular Weight ($M_w$) | Number Average Molecular Weight ($M_n$) |
|---|---|---|---|---|
| 23 | 1.5 | 0 | 112000 | 49800 |
| | | 50 | 4270 | 2700 |
| | | 150 | 3550 | 2300 |
| | | 300 | 4230 | 2490 |
| 24 | 1.8 | 0 | 113000 | 52700 |
| | | 50 | 3990 | 2710 |
| | | 150 | 4180 | 3110 |
| | | 300 | 2890 | 2110 |
| 25 | 3.5 | 0 | 124000 | 41700 |
| | | 50 | 4580 | 2860 |
| | | 150 | 4080 | 2520 |
| | | 300 | 3760 | 2300 |

As can be seen from the data in Table 3, Control I which was 100 percent poly(propylene) without metal stearate or auto-oxidant had very little weight loss after 300 hours in an oven at 60° C. and no decrease in weight average molecular weight ($M_w$) or number average molecular weight ($M_n$), indicating substantially no degradation. Comparative examples which have microfibers of 100 percent poly (propylene) with manganese stearate alone, manganese stearate or cobalt stearate and oleic acid degraded extensively, as evidenced by weight loss and molecular weight decrease.

The molecular weight data indicates that no degradation occurred in webs having microfibers of 100 percent poly (caprolactone) with manganese or cobalt stearate and oleic acid, webs having microfibers of 100 percent poly(vinyl alcohol) with manganese or cobalt stearate and oleic acid, and the web having microfibers of 100 percent poly(lactic acid) with cobalt stearate and oleic acid.

In the comparative example having microfibers of 100 percent modified poly(ethylene terephthalate) (PET) with cobalt stearate and oleic acid, there was little weight loss and no molecular weight data was obtained due to insolubility of this polymer in appropriate solvents.

In the examples which contained five-layer microfibers of 50/50 poly(propylene)/poly(caprolactone) with manganese stearate and oleic acid or stearic acid in the poly(propylene) and in the example which contained five-layer microfibers 75/25 poly(propylene)/poly(caprolactone) also with manganese stearate and oleic acid in the poly(propylene), the poly(caprolactone) degraded as well as the poly(propylene). However, the poly(caprolactone) fraction degraded more slowly than the poly(propylene) fraction and the 50/50 combination peaked at a higher molecular weight during degradation.

In the following examples, each fiber layer, whether it contained manganese stearate or cobalt stearate and an auto-oxidant or not, was observed to undergo extensive degradation, evidenced by weight loss and/or molecular weight decrease: webs of comparative examples having microfibers of 100% poly(propylene) with manganese stearate and oleic acid in some of the poly(propylene) layers, the web having five-layer microfibers of 50/50 poly(propylene) /Kodak™ AQ polyester (PEH) with manganese stearate and oleic acid in the polypropylene) layers, and the webs having five-layer microfibers of 50/50 and 75/25 poly(propylene)/ polyurethane respectively with manganese stearate and oleic acid in the poly(propylene) layers. However, 100% polyurethane with manganese or cobalt stearate and oleic acid degraded on its own. Webs having five-layer microfibers of 50/50 and 75/25 poly(propylene)/poly(vinyl alcohol) with manganese stearate and oleic acid in the poly(propylene) layers, webs having five-layer microfibers of 50/50 and 75/25 Poly(propylene)/poly(hydroxybutyrate-valerate) with manganese stearate and oleic acid in the poly(propylene) layers each showed extensive degradation in each layer.

In the webs having five-layer microfibers of 50/50 and 75/25 poly(propylene)/hydrolyzable polyester (PES) with manganese stearate and oleic acid in the poly(propylene) layers, the molecular weight data on the 50/50 poly (propylene)/hydrolyzable polyester web did not clearly indicate degradation, but the results on the 75/25 poly (propylene)/hydrolyzable polyester web indicated degradation of the entire web.

In the webs having five-layer microfibers of 50/50 and 75/25 poly(propylene)/poly(lactic acid) with manganese stearate and oleic acid in the poly(propylene) layers, the molecular weight changes indicated minor degradation.

In the webs having five-layer microfibers of 50/50 and 75/25 poly(propylene)/modified poly(ethylene terephthalate) (PET) with manganese stearate and oleic acid in the poly(propylene) layers, the molecular weight data was inconclusive as to the degradation of the modified poly (ethylene terephthalate) due to insolubility, but the poly (propylene) layers were degraded.

TABLE 4

| Example No. | 50 hours (%) | 100 hours (%) | 150 hours (%) | 200 hours (%) | 300 hours (%) | 500 hours (%) |
|---|---|---|---|---|---|---|
| 4 | <1 | <1 | <1 | <1 | <1 | 2 |
| 10 | <1 | <1 | <1 | <1 | <1 | 2 |
| 11 | <1 | 1.3 | 1.3 | 2.2 | 5.5 | emb |
| 12 | <1 | <1 | <1 | 1.2 | <1 | emb |
| 13 | <1 | <1 | <1 | <1 | <1 | 3 |
| 14 | <1 | <1 | <1 | <1 | <1 | 9.8 |
| 15 | 8.2 | 9.2 | 9.6 | 8.5 | 10.3 | 10.2 |
| 16 | <1 | <1 | <1 | <1 | <1 | <1 |
| 17 | <1 | <1 | <1 | <1 | <1 | <1 |
| 18 | 56 | 60.6 | 65.2 | 65.4 | 55.8 | 63.8 |
| 19 | 42.9 | 49.5 | 48.8 | 41.3 | 38.5 | 40.3 |
| 20 | 1.2 | 2 | 8.1 | 8 | 9.5 | 18.9 |
| 21 | 1.2 | 3.2 | 4.6 | 5.1 | 11.4 | 13.5 |
| 22 | <1 | <1 | <1 | <1 | <1 | <1 |
| 23 | 1.2 | <1 | 3 | <1 | 1.5 | 2 |
| 24 | <1 | <1 | <1 | <1 | 1.8 | 7.3 |
| 25 | <1 | <1 | <1 | <1 | 3.5 | 3 |

The results in Table 4 indicate that webs containing water soluble or hydrolytically degradable polymers had relatively high percent weight losses in the Weight Loss Test in water at 60° C. Webs which underwent weight loss and/or disintegrated in this test were expected to perform well in the Compost Simulated Test. The embrittlement data for these examples were described in Table 2.

TABLE 5

| Example No. | Time (days) | Initial Weight (g) | Final Weight (%) | Weight Loss (%) |
|---|---|---|---|---|
| 4 | 10 | 0.3368 | 0.2500 | 25.77 |
| | 20 | 0.3341 | 0.2077 | 37.83 |
| | 30 | 0.3254 | 0.1964 | 39.64 |
| | 45 | 0.3744 | 0.2193 | 41.43 |
| 10 | 10 | 0.3994 | 0.3478 | 12.92 |
| | 20 | 0.4023 | 0.2079 | 48.32 |
| | 30 | 0.4076 | 0.1996 | 51.03 |
| | 45 | 0.3961 | 0.2020 | 49.00 |
| 11 | 10 | 0.3602 | 0.3658 | −1.55 |
| | 20 | 0.3965 | 0.3431 | 13.47 |
| | 30 | 0.3568 | 0.3080 | 13.68 |
| | 45 | 0.3595 | 0.2910 | 19.05 |
| 13 | 10 | 0.3636 | 0.3600 | 0.99 |
| | 20 | 0.4115 | 0.4085 | 0.73 |
| | 30 | 0.3410 | 0.3483 | −2.14 |
| | 45 | 0.3869 | 0.3921 | −1.34 |
| 15 | 10 | 0.3794 | 0.3652 | 3.74 |
| | 24 | 0.4041 | 0.3837 | 5.05 |
| | 30 | 0.3686 | 0.3553 | 3.61 |
| | 45 | 0.3543 | 0.3371 | 4.85 |
| 16 | 10 | 0.3778 | 0.3795 | −0.45 |
| | 24 | 0.3526 | 0.3629 | −2.92 |
| | 30 | 0.3668 | 0.3733 | −1.77 |
| | 45 | 0.3543 | 0.3751 | −5.87 |
| 18 | 10 | 0.4218 | 0.2161 | 48.77 |
| | 20 | 0.4001 | 0.2152 | 46.21 |
| | 30 | 0.4538 | 0.2657 | 41.45 |
| | 45 | 0.4367 | 0.2291 | 47.54 |
| 20 | 10 | 0.3623 | 0.3520 | 2.84 |
| | 20 | 0.3989 | 0.3602 | 9.70 |
| | 30 | 0.3875 | 0.3303 | 14.76 |
| | 45 | 0.3894 | 0.2968 | 23.78 |
| 21 | 10 | 0.3663 | 0.3551 | 3.06 |
| | 20 | 0.3611 | 0.3575 | 1.00 |
| | 30 | 0.3980 | 0.3780 | 5.03 |
| | 45 | 0.3486 | 0.3213 | 7.83 |
| 22 | 10 | 0.3994 | 0.3970 | 0.60 |
| | 20 | 0.4056 | 0.2993 | 26.21 |
| | 30 | 0.3678 | 0.2706 | 26.43 |
| | 45 | 0.3817 | 0.2808 | 26.43 |
| 23 | 10 | 0.3757 | 0.3652 | 2.79 |
| | 20 | 0.4079 | 0.3584 | 12.14 |
| | 30 | 0.3971 | 0.362O | 8.84 |
| | 45 | 0.3765 | 0.3452 | 8.31 |
| 24 | 10 | 0.4179 | 0.4173 | 0.14 |
| | 20 | 0.4170 | 0.4097 | 1.75 |
| | 30 | 0.4322 | 0.4260 | 1.43 |
| | 45 | 0.4192 | 0.4129 | 1.50 |

The data in Table 5 demonstrates that webs containing biodegradable or hydrolyzable resins showed significant weight loss when subjected to the Composting Simulation Test. In addition, webs were tested for embrittlement at two to three day intervals. Webs having five-layer microfibers of 50/50 poly(propylene)/poly(caprolactone), 25/75 poly (propylene)/poly(caprolactone), and 75/25 poly(propylene) /poly(caprolactone), respectively, with manganese stearate and oleic acid in the poly(propylene) contain poly (caprolactone) which is biodegradable. The web of 25/75 poly(propylene)/poly(caprolactone) was actually embrittled in 30 days in the compost and the webs of 50/50 poly (propylene)/poly(caprolactone) and 75/25 poly(propylene)/ poly(caprolactone) both embrittled in 49 days in the compost. The web having five-layer microfibers of 50/50 poly (propylene)/poly(vinyl alcohol) with manganese stearate and oleic acid in the poly(propylene) contains the poly(vinyl alcohol) which is water soluble and biodegradable and the web was embrittled after 42 days in the compost. The web having five-layer microfibers of 50/50 poly(propylene)/poly (lactic acid) with manganese stearate and oleic acid in the poly(propylene) contains the poly(lactic acid) which is biodegradable and the web was embrittled in 42 days of testing and the web of 75/25 poly(propylene)/poly(lactic acid) embrittled in 49 days. The web having five-layer microfibers of 50/50 poly(propylene)/poly(hydroxybutyrate-valerate) with manganese stearate and oleic acid in the poly (propylene) contains the biodegradable poly (hydroxybutyrate-valerate) and embrittled in 49 days. The remaining samples in Table 5 were not seen to undergo embrittlement during the 58 day test period.

TABLE 6

| Example No. | Modulus (MPa) | Strain @ Break (%) |
|---|---|---|
| Control II | 18.09 | 38 |
| Comp. A | 9.66 | 80 |
| Comp. B | 8.43 | 132 |
| Comp. C | 19.87 | 74 |
| 1 | 11.60 | 54 |
| 2 | 8.84 | 45 |
| 3 | 16.06 | 74 |
| 4 | 10.44 | 97 |
| 5 | 7.84 | 98 |
| 6 | 10.79 | 49 |
| 7 | 10.08 | 102 |
| 8 | 9.97 | 88 |
| 9a | 10.52 | 87 |
| 9b | 14.47 | 56 |
| 10 | 10.88 | 70 |
| 11 | 15.69 | 137 |
| 12 | 24.48 | 127 |
| 13 | 12.77 | 69 |
| 14 | 3.00 | 85 |
| 15 | 24.77 | 125 |
| 16 | 9.62 | 929 |
| 17 | 12.93 | 268 |
| 18 | 4.89 | 52 |
| 22 | 32.42 | 175 |
| 23 | 27.59 | 206 |
| 24 | 8.47 | 126 |
| 25 | 12.34 | 82 |

As can be seen from the data in Table 6, tensile modulus and percent strain at break, measured on the initial five-layer webs indicates that the webs of the invention initially had useable tensile moduli.

Examples 26–36

Eleven microfiber webs having a basis weight as shown in Table 7 and comprising two-layer microfibers having an average diameter of less than about 10 micrometers were prepared according to the procedure of Examples 1–11, except the poly(propylene) and poly(caprolactone) melt streams were delivered to a two-layer feedblock, the first extruder was heated to about 240° C., the second extruder was heated to about 190° C., the feedblock assembly was heated to about 240° C., the die and air temperatures were maintained at about 240° C. and 243° C., respectively. The amount of manganese stearate and/or the amount of oleic acid used in the poly(propylene) and/or the poly (caprolactone) and the pump ratios are given in Table 7.

Examples 26–30 were exposed to three different temperatures in an oven to determine the amount of time needed to embrittle the webs as described in the test procedures above. Examples 26–30 were aged at a higher temperature (93° C.) in an oven and removed at regular intervals to determine weight loss as described in the test procedures above. The results are given in Table 8.

Examples 31–32 were aged at 93° C. for intervals of 50, 100, 150, 200, and 250 hours and the weight loss determined. The results are given in Table 9.

Examples 33–36 were also aged at 93° C. for intervals of 150 and 250 hours and the loss of weight determined. In addition to the weight loss, weight average molecular weights and number average molecular weights were determined using gel permeation chromatography (GPC). The results are given in Table 10.

Examples 37–38

Two microfiber webs comprising three-layer microfibers having an average diameter of less than about 10 micrometers were prepared according to the procedure of Examples 26–36, except that the poly(propylene) and poly (caprolactone) melt streams were delivered to a three-layer feedblock. The amount of manganese stearate used in the poly(propylene) and the pump ratios are given in Table 7.

Examples 37–38 were aged at 93° C. for intervals of 50, 100, 150, 200, and 250 hours and the loss of weight determined. The results are given in Table 9.

Examples 39–40

Two microfiber webs comprising five-layer microfibers having an average diameter of less than about 10 micrometers were prepared according to the procedure of Examples 26–36, except that the poly(propylene) and poly (caprolactone) melt streams were delivered to a five-layer feedblock. The amount of manganese stearate used in the poly(propylene) and the pump ratios are given in Table 7.

Examples 39–40 were aged at 93° C. for intervals of 50, 100, 150, 200, and 250 hours and the loss of weight determined. The results are given in Table 9.

Examples 41–42

Two microfiber webs comprising nine-layer microfibers having an average diameter of less than about 10 micrometers were prepared according to the procedure of Examples 26–36, except that the polypropylene) and poly (caprolactone) melt streams were delivered to a nine-layer feedblock. The amount of manganese stearate used in the poly(propylene) and the pump ratios are given in Table 7.

Examples 41–42 were aged at 93° C. for intervals of 50, 100, 150, 200, and 250 hours and the loss of weight determined. The results are given in Table 9.

Examples 43–44

Two microfiber webs comprising nine-layer microfibers having an average diameter of less than about 10 micrometers were prepared according to the procedure of Examples 41–42 except that a different polypropylene (Dypro™3576 available from Shell Chemical Co., Houston, Tex.) was substituted for the polypropylene resin in the first extruder. The amount of manganese stearate used in the polypropylene) and the pump ratios are given in Table 7.

Examples 43–44 were aged at 93° C. for intervals of 150 and 250 hours and the loss of weight determined. In addition to the weight loss, weight average molecular weights and number average molecular weights were determined using GPC. The results are given in Table 10.

Examples 45–53

Nine microfiber webs comprising twenty-seven-layer microfibers having an average diameter of less than about 10 micrometers were prepared according to the procedure of Examples 26–36, except that the poly(propylene) and poly (caprolactone) melt streams were delivered to a twenty-seven-layer feedblock. The amount of manganese stearate and/or the amount of oleic acid used in the poly(propylene) and/or the poly(caprolactone) and the pump ratios are given in Table 7.

Examples 45–49 were exposed to three different temperatures in an oven to determine the amount of time needed to embrittle the webs as described in the test procedures above. Examples 26–30 were aged at a higher temperature (93° C.) in an oven and removed at regular intervals to determine weight loss as described in the test procedures above. The results are given in Table 8.

Examples 50–52 were aged at 93° C. for intervals of 50, 100, 150, 200, and 250 hours and the loss of weight determined. The results are given in Table 9.

Example 53 was also aged at 93° C. for intervals of 150 and 250 hours and the loss of weight determined. In addition to the weight loss, weight average molecular weights and number average molecular weights were determined using GPC. The results are given in Table 10.

Control Web III

A control web comprising twenty-seven-layer microfibers having an average diameter of less than about 10 micrometers was prepared according to the procedure of Control Web II, except that the poly(propylene) and poly(caprolactone) melt streams were delivered to a twenty-seven-layer feedblock.

Control Web III was aged at 93° C. for intervals of 150 and 250 hours and the loss of weight determined. In addition to the weight loss, weight average molecular weights and number average molecular weights were determined using GPC. The results are given in Table 10.

TABLE 7

| Ex. No. | PP Polymer 1 (g) | PCL Polymer 2 (g) | Mn Stearate Amount (g) | Oleic Acid Amount (g) | Pump Ratio Polymer 1: Polymer 2 | No. of layers | Basis Weight (g/m$^2$) |
|---|---|---|---|---|---|---|---|
| 26 | 750 | 500 | 2.5 in PCL | 0 | 90 PP:10 PCL | 2 | 50 |
| 27 | 750 | 500 | 0.417 in PP | 0 | 90 PP:10 PCL | 2 | 51 |
| 28 | 750 | 500 | 2.5 in PCL | 16.7 in PP | 90 PP:10 PCL | 2 | 52 |
| 29 | 750 | 500 | 0.417 in PP | 16.7 in PP | 90 PP:10 PCL | 2 | 50 |
| 30 | 750 | 500 | 2.5 in PCL<br>0.417 in PP | 0 | 90 PP:10 PCL | 2 | 52 |
| 31 | 750 | 500 | 2.5 in PCL | 0 | 90 PP:10 PCL | 2 | |
| 32 | 750 | 500 | 0.5 in PP | 0 | 75 PP:25 PCL | 2 | |
| 33 | 500 | 500 | 0.5 in PCL | 0 | 75 PP:25 PCL | 2 | 21 |
| 34 | 500 | 500 | 0.5 in PCL | 0 | 50 PP:50 PCL | 2 | 100 |
| 35 | 500 | 500 | 0.5 in PP | 0 | 50 PP:50 PCL | 2 | 100 |
| 36 | 500 | 500 | 0.5 in PP | 0 | 50 PP:50 PCL | 2 | 26 |
| 37 | 750 | 500 | 0.42 in PP | 0 | 90 PP:10 PCL | 3 | |
| 38 | 750 | 500 | 0.5 in PP | 0 | 75 PP:25 PCL | 3 | |

TABLE 7-continued

| Ex. No. | PP Polymer 1 (g) | PCL Polymer 2 (g) | Mn Stearate Amount (g) | Oleic Acid Amount (g) | Pump Ratio Polymer 1: Polymer 2 | No. of layers | Basis Weight (g/m$^2$) |
|---|---|---|---|---|---|---|---|
| 39 | 750 | 500 | 0.42 in PP | 0 | 90 PP:10 PCL | 5 | |
| 40 | 750 | 500 | 0.5 in PP | 0 | 75 PP:25 PCL | 5 | |
| 41 | 750 | 500 | 0.42 in PP | 0 | 90 PP:10 PCL | 9 | 50 |
| 42 | 750 | 500 | 0.5 in PP | 0 | 75 PP:25 PCL | 9 | 49 |
| 43 | 750 | 500 | 0.5 in PP | 0 | 90 PP:10 PCL | 9 | 100 |
| 44 | 750 | 500 | 0.5 in PP | 0 | 60 PP:40 PCL | 9 | 100 |
| 45 | 750 | 500 | 2.5 in PCL | 0 | 90 PP:10 PCL | 27 | 51 |
| 46 | 750 | 500 | 0.417 in PP | 0 | 90 PP:10 PCL | 27 | 50 |
| 47 | 750 | 500 | 2.5 in PCL | 16.7 in PP | 90 PP:10 PCL | 27 | 51 |
| 48 | 750 | 500 | 0.417 in PP | 16.7 in PP | 90 PP:10 PCL | 27 | 50 |
| 49 | 750 | 500 | 2.5 in PCL<br>0.417 in PP | 0 | 90 PP:10 PCL | 27 | 51 |
| 50 | 750 | 500 | 0.42 in PP | 0 | 90 PP:10 PCL | 27 | 50 |
| 51 | 750 | 500 | 0.5 in PP | 0 | 75 PP:25 PCL | 27 | 51 |
| 52 | 750 | 500 | 1.0 in PCL | 0 | 75 PP:25 PCL | 27 | 51 |
| 53 | 750 | 750 | 0.5 in PP | 0 | 50 PP:50 PCL | 27 | 100 |
| Control III | 750 | 750 | 0 | 0 | 50 PP:50 PCL | 27 | 100 |

TABLE 8

| | | Time to Embrittlement (hours) | | | Weight Loss at 93° C. in an Oven | |
|---|---|---|---|---|---|---|
| Ex. No. | Composition | at 70° C. | at 60° C. | at 49° C. | Time (hrs) | Weight Loss (%) |
| Two-Layer Fibers | | | | | | |
| 26 | Mn in PCL | 360 | 600 | >600 | 150 | 5.39 |
| | | | | | 250 | 11.51 |
| 27 | Mn in PP | 145 | 360 | 530 | 150 | 5.61 |
| | | | | | 250 | 11.57 |
| 28 | Mn in PCL, OA in PP | 50 | 120 | 120 | 150 | 6.12 |
| | | | | | 250 | 10.01 |
| 29 | Mn & OA in PP | 25 | 48 | 95 | 150 | 7.02 |
| | | | | | 250 | 11.37 |
| 30 | Mn in PCL & PP | 77 | 120 | 360 | 150 | 8.75 |
| | | | | | 250 | 15.49 |
| Twenty-seven-Layer Fibers | | | | | | |
| 45 | Mn in PCL | 360 | 660 | >600 | 150 | 4.19 |
| | | | | | 250 | 13.34 |
| 46 | Mn in PP | 145 | 360 | 550 | 150 | 6.53 |
| | | | | | 250 | 13.62 |
| 47 | Mn in PCL, OA in PP | 25 | 48 | 95 | 150 | 5.88 |
| | | | | | 250 | 10.21 |
| 48 | Mn & OA in PP | 25 | 48 | 95 | 150 | 6.27 |
| | | | | | 250 | 10.95 |
| 49 | Mn in PCL & PP | 50 | 360 | 360 | 150 | 8.71 |
| | | | | | 250 | 14.90 |

When only manganese stearate was used, the lowest embrittlement times were observed for the webs where manganese stearate was added to both the poly(propylene) and poly(caprolactone). The placement of the manganese stearate only in the poly(propylene) layers was also effective, as was, surprisingly, placement of manganese stearate only in the poly(caprolactone) layers.

Webs containing both manganese stearate and oleic acid in poly(propylene) exhibited the lowest times to embrittlement. Webs containing manganese stearate in poly (caprolactone) and oleic acid in poly(propylene) had the next lowest times to embrittlement followed by webs containing manganese stearate in both poly(propylene) and poly(caprolactone).

Holding web composition constant, the number of layers had little effect on the amount of degradation as can be seen in the percent weight loss. Time to embrittlement appeared to be the better indicator of performance of a degradable web than the high temperature weight loss results.

TABLE 9

| Ex. No. | Layers | 50 hrs (%) | 100 hrs (%) | 150 hrs (%) | 200 hrs (%) | 250 hrs (%) |
|---|---|---|---|---|---|---|
| 31 | 2 | 2.03 | 10.15 | 14.29 | 19.22 | 21.90 |
| 32 | 2 | −0.32 | 6.56 | 12.76 | 15.22 | 17.87 |
| 37 | 3 | 3.33 | 8.89 | 16.65 | 18.90 | 23.80 |
| 38 | 3 | 3.34 | 12.64 | 22.10 | 22.41 | 23.87 |

TABLE 9-continued

| Ex. No. | Layers | 50 hrs (%) | 100 hrs (%) | 150 hrs (%) | 200 hrs (%) | 250 hrs (%) |
|---|---|---|---|---|---|---|
| 39 | 5 | −1.74 | 6.51 | 12.12 | 14.44 | 16.50 |
| 40 | 5 | −1.90 | 4.34 | 8.43 | 11.60 | 13.79 |
| 41 | 9 | 1.39 | 11.38 | 15.93 | 19.08 | 21.96 |
| 42 | 9 | 0.03 | 6.85 | 10.93 | 13.36 | 16.02 |
| 50 | 27 | 4.73 | 16.46 | 22.12 | 26.52 | 28.60 |
| 51 | 27 | −1.92 | 5.97 | 11.27 | 15.92 | 17.15 |
| 52 | 27 | 0.2 | 7.11 | 14.23 | 16.87 | 20.25 |

As can be seen from the data in Table 9, webs containing two-, three-, five-, nine- and twenty-seven-layer microfibers exhibited weight loss upon aging in the oven at 93° C. Time appeared to be the only consistently significant factor shown by statistical analysis. In general, higher weight losses were observed for samples containing higher percentages of poly (propylene). The highest percent weight losses were observed for the three-and twenty-seven-layer webs.

TABLE 10

| Ex. No. | Layers | Weight Loss at 93° C. 150 hrs | 200 hrs | 250 hrs | Time (hrs) | Weight Average Molecular weight ($M_w$) | Number Average Molecular Weight ($M_n$) |
|---|---|---|---|---|---|---|---|
| 33 | 2 | 13.30 | — | 18.39 | 0 | 33300 | 8940 |
| | | | | | 150 | 1180 | 980 |
| | | | | | 250 | 1030 | 900 |
| 34 | 2 | 9.41 | — | 13.29 | 0 | 35500 | 11800 |
| | | | | | 150 | 1220 | 980 |
| | | | | | 250 | 860 | 800 |
| 35 | 2 | 6.10 | — | 11.74 | 0 | 35500 | 11800 |
| | | | | | 150 | 1060 | 280 |
| | | | | | 250 | 960 | 860 |
| 36 | 2 | 17.29 | — | 27.08 | 0 | 35500 | 11800 |
| | | | | | 150 | 960 | 860 |
| | | | | | 250 | 850 | 780 |
| 43 | 9 | — | 10.40 | — | 0 | 145000 | 30600 |
| | | | | | 200 | 1460 | 1030 |
| 44 | 9 | — | 14.60 | — | 0 | 135000 | 24600 |
| | | | | | 200 | 1240 | 1060 |
| Control III | 27 | — | −0.07 | — | 0 | 31500 | 11300 |
| | | | | | 200 | 33700 | 11400 |
| 53 | 27 | — | 14.28 | — | 0 | 35600 | 11800 |
| | | | | | 200 | 1070 | 930 |

As can be seen from the data in Table 10, the twenty-seven-layer web containing no manganese stearate had no significant molecular weight change or weight loss, while the twenty-seven-layer microfiber web containing manganese stearate in the poly(propylene) underwent significant weight loss upon aging and the molecular weight changes were significant. Similar results were observed for the two-and nine-layer microfiber webs of equivalent basis weight. Webs produced from two-layer microfibers with a lower basis weight had higher percent weight losses upon aging at 93° C. due to the greater web surface area per mass. Any differences observed in the extent of degradation, as evidenced by molecular weight change, for the web examples containing two-, nine-or twenty-seven-layer microfibers were insignificant.

Various modifications and alterations of this invention will be apparent to those skilled in the art without departing from the scope and spirit of this invention and this invention should not be restricted to that set forth herein for illustrative purposes.

We claim:

1. Multilayer melt blown microfibers comprising (a) at least one layer of polyolefin resin and at least one layer of polycaprolactone resin, at least one of the polyolefin or polycaprolactone resins containing a transition metal salt; or (b) at least one layer of polyolefin resin containing a transition metal salt and at least one layer of a degradable resin or transition metal salt-free polyolefin resin.

2. The multilayer melt blown microfibers of claim 1 wherein said polyolefin is poly(ethylene), polypropylene), copolymers of ethylene and propylene, poly(butylene), poly (4-methyl-1-pentene) or a combination thereof.

3. The multilayer melt blown microfibers of claim 1 wherein said degradable resin is biodegradable, compostable, hydrolyzable, water soluble or a combination thereof.

4. The multilayer melt blown microfibers of claim 3 wherein said biodegradable resin is poly(caprolactone), a poly(hydroxyalkanoate), poly(vinyl alcohol), poly(ethylene vinyl alcohol), poly(ethylene oxide) or plasticized carbohydrate.

5. The multilayer melt blown microfibers of claim 4 wherein said poly(hydroxyalkanoate) is poly (hydroxybutyrate) or poly(hydroxybutyrate-valerate).

6. The multilayer melt blown microfibers of claim 3 wherein said compostable resin is a modified poly(ethylene terephthalate) or an extrudable starch-based resin.

7. The multilayer melt blown microfibers of claim 3 wherein said hydrolyzable resin is poly(lactic acid), a cellulose ester, poly(vinyl acetate), a polyester amide, hydrolytically sensitive polyester or a polyurethane.

8. The multilayer melt blown microfibers of claim 3 wherein said water soluble resin is poly(vinyl alcohol) or poly(acrylic acid).

9. The multilayer melt blown microfibers of claim 1 wherein said transition metal salts have organic or inorganic ligands.

10. The multilayer melt blown microfibers of claim 9 wherein said organic ligands are octanoates, acetates, stearates, oleates, naphthenates, linoleates or tallates.

11. The multilayer melt blown microfibers of claim 9 wherein said inorganic ligands are chlorides, nitrates or sulfates.

12. The multilayer melt blown microfibers of claim 1 wherein said transition metal is cobalt, manganese, copper, cerium, vanadium, or iron.

13. The multilayer melt blown microfibers of claim 1 wherein said transition metal is present in the polymer composition in an amount of about 5 to 500 ppm.

14. The multilayer melt blown microfibers of claim 1 further comprising a fatty acid, fatty acid ester or combination thereof.

15. The multilayer melt blown microfibers of claim 14 wherein said fatty acid, fatty acid ester or combination thereof is present in the polymer composition at a concentration of about 0.1 to 10 weight percent.

16. The multilayer melt blown microfibers of claim 14 wherein said fatty acid is oleic acid, linoleic acid, eleostearic acid, or stearic acid.

17. The multilayer melt blown microfibers of claim 14 wherein said fatty acid ester is tung oil, linseed oil or fish oil.

18. The multilayer melt blown microfibers of claim 14 wherein said fatty acid is present in sufficient concentration to provide a concentration of free acid species greater than 0.1 percent by weight based on the total composition.

19. The multilayer melt blown microfibers of claim 14 wherein said fatty acid ester is present in sufficient concentration to provide a concentration of unsaturated species greater than 0.1 percent by weight based on the total composition.

20. The multilayer melt blown microfibers of claim 14 wherein said combination of fatty acid and fatty acid ester is present in sufficient concentration to provide a concentration of unsaturated species greater than 0.1 percent by weight and 0.1 percent by weight based on the total composition.

21. A web comprising multilayer melt blown microfibers comprising (a) at least one layer of polyolefin resin and at least one layer of polycaprolactone resin, at least one of the polyolefin or polyeaprolactone resins containing a transition metal salt; or (b) at least one layer of polyolefin resin containing a transition metal salt and at least one layer of a degradable resin or transition metal salt-free polyolefin resin.

22. The web of claim 21 wherein said web degrades to embrittlement within about 14 days at a temperature of 60° C. and a relative humidity of at least 80%.

23. The web of claim 21 further comprising a fatty acid, fatty acid ester or combination thereof.

* * * * *

UNITED STATES PATENT AND TRADEMARK OFFICE

CERTIFICATE OF CORRECTION

PATENT NO.: 5,814,404

DATED: September 29, 1998

INVENTOR(S): Rutherford et al.

It is certified that error appears in the above-identified patent and that said Letters Patent is hereby corrected as shown below:

Col. 26, line 10, "polypropylene)" should read –poly(propylene)--.

Col. 28, line 13, "polyeaprolactone" should read –polycaprolactone--.

Signed and Sealed this

Twenty-third Day of March, 1999

*Attest:*

Q. TODD DICKINSON

*Attesting Officer*

*Acting Commissioner of Patents and Trademarks*